United States Patent [19]

Mount et al.

[11] 4,375,939

[45] Mar. 8, 1983

[54] CAPACITY-PREWHIRL CONTROL MECHANISM

[75] Inventors: Gordon L. Mount, West Monroe; Edward A. Huenniger, Liverpool; Jarso Mulugeta, East Syracuse, all of N.Y.

[73] Assignee: Carrier Corporation, Syracuse, N.Y.

[21] Appl. No.: 191,983

[22] Filed: Sep. 29, 1980

[51] Int. Cl.[3] ..... F04D 29/46; F04D 29/56

[52] U.S. Cl. ..... 415/157; 415/151; 138/43; 138/45

[58] Field of Search ..... 415/148, 151, 157, 158, 415/147, 127, 150; 251/126; 138/43, 45, 42, 44, 46, 40

[56] References Cited

U.S. PATENT DOCUMENTS 2,218,643 10/1940 Heinriksen ..... 415/157
2,649,273 8/1953 Honegger ..... 251/126
2,692,080 10/1954 Schwaiger ..... 415/147
2,923,526 2/1960 Street, Jr. ..... 415/157

*Primary Examiner*—Philip R. Coe
*Assistant Examiner*—Joseph M. Pitko
*Attorney, Agent, or Firm*—Donald F. Daley; David J. Zobkiw

[57] ABSTRACT

In a centrifugal gas compressor the capacity and the prewhirl of the entering gas are both controlled by reciprocating a plug which is located in the flow path. The plug coacts with tapering walls of the flow path to vary the minimum cross-sectional area of the flow path. Additionally vanes are provided either in the wall of the flow path or on the plug. The vanes transition from an axial direction to a helical direction and of reducing height in a downstream direction so as to produce increasing prewhirl with decreasing capacity. Alternatively, prewhirl may be provided without capacity control.

6 Claims, 6 Drawing Figures

CAPACITY-PREWHIRL CONTROL MECHANISM

BACKGROUND OF THE INVENTION

One of the major problems arising in the use of centrifugal gas compressors for applications where the compression load varies over a wide range is flow stabilization through the compressor. The compressor inlet, impeller and diffuser passage must be sized to provide for the maximum volumetric flow rate desired. In centrifugal refrigerant compressors, the loads typically vary over a wide range and they may be operated at such low flow rates that their inlets and diffusers are too large for efficient operation. When there is a low volumetric flow rate through such a compressor, the flow becomes unstable. As the volumetric flow rate is decreased from a stable range, a range of slightly unstable flow is entered. In this range, flow in both the impeller and the diffuser becomes separated from the wall along the entire length of the flow passage and there appears to be a partial reversal of flow in the diffuser passage creating noises and lowering the compressor efficiency. Below this range, the compressor enters what is known as surge, wherein there are periodic complete flow reversals in the diffuser passage destroying the efficiency of the machine.

Various techniques have been used to increase the range between the surge and choke limits of a compressor.

Guide vanes located in the inlet of the compressor have been employed to vary the flow direction and quantity of the entering gas since the work done by an impeller is proportional to the difference of the square of the gas velocity at the impeller exit and the impeller inlet. Inlet guide vanes improve efficiency because they impart a swirl to the gas at the impeller inlet in the direction of rotation thus reducing the velocity difference. The lift capability of the compressor is also reduced, but for normal air conditioning applications this is no problem because the required lift also falls off as load decreases. Sometimes, mechanically connected to these guide vanes is movable diffuser structure to throttle the diffuser passage as the inlet flow is reduced.

SUMMARY OF THE INVENTION

In accordance with the present invention, a plug is coaxially and reciprocatably located in the compressor inlet to control the amount of gas entering the compressor. In the preferred embodiment, vanes are located on the plug to give an increasing prewhirl to the entering gas as the compressor load drops. In an alternative embodiment, the vanes are located on the walls of the inlet. Prewhirl may also be provided without capacity control.

It is an object of this invention to provide a gas compressor having means therein to stabilize the gas flow therethrough at extremely low flow rates.

It is a further object of this invention to provide a centrifugal compressor in which the compressor efficiency is optomized over a wide range of flow rates.

It is an additional object of this invention to provide a linear inlet capacity control.

It is a further object of the invention to provide a linear capacity control which produces a prewhirl to entering gas in a centrifugal compressor.

It is an additional object of this invention to provide prewhirl control for a compressor.

It is a yet still further object of this invention to provide a movable vaned plug in which the inlet area and corresponding vane angle vary in a predetermined manner. These objects, and others as will become apparent hereinafter, are accomplished by the present invention.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
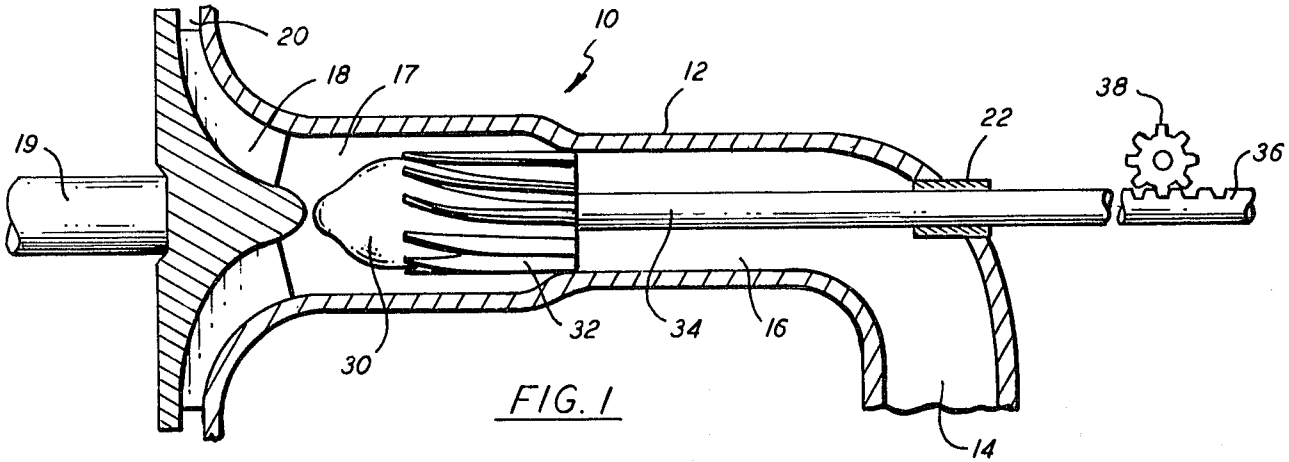
FIG. 1 is a sectional view of a gas compressor employing the capacity-prewhirl control mechanism of the present invention in the full open position.

In FIG. 1, the numeral 10 generally designates a centrifugal gas compressor of a refrigeration system. Low pressure gaseous refrigerant enters the inlet 14 of housing 12, passes through passage 16 which transitions into compressor inlet chamber 17, to the impeller 18 and thence into diffuser passage 20. The impeller 18 is driven through shaft 19 by a motor (not illustrated). In such an arrangement, it is conventional to provide flow control structure, such as inlet guide vanes in the passage upstream of the impeller and to control the vane position in response to the temperature of the chilled water leaving the machine. Accordingly, compressor 10 is provided with a plug 30 having vanes 32 thereon and the plug 30 and vanes 32 constitute the capacity-prewhirl control mechanism of the present invention. The plug 30 which is shown in the full open position in FIG. 1 has a shaft portion 34 which is slidably supported in passage 16 and gland 22 and which extends through housing 12, terminating in a rack 36. The rack 36 coacts with pinion 38 which is driven by a motor (not illustrated) in response to the chilled water temperature, as is conventional.

Figure 2:
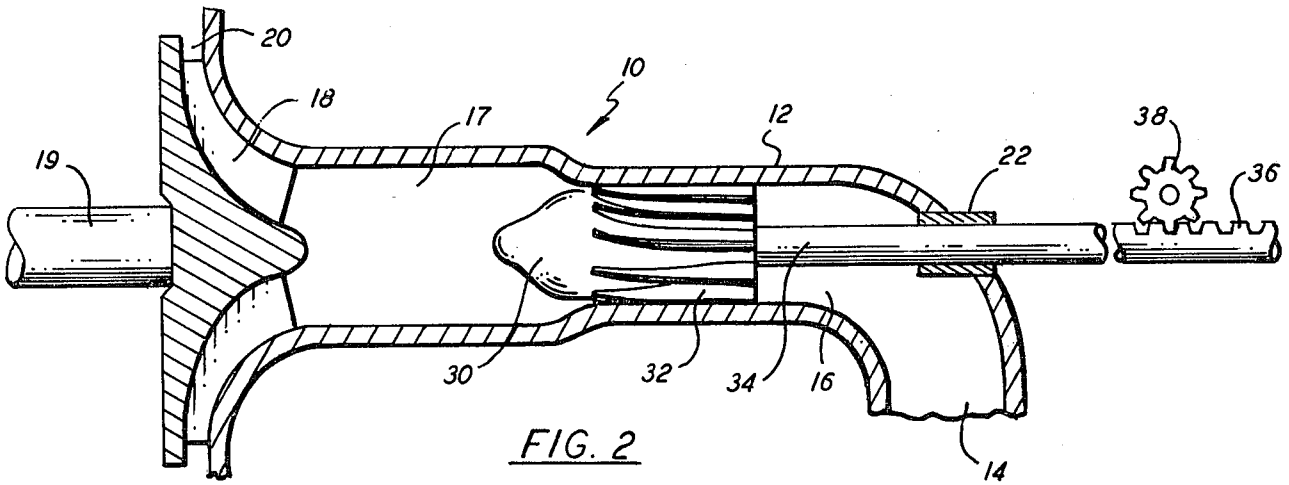
FIG. 2 shows the capacity-prewhirl control mechanism of FIG. 1 in the minimum flow position.

In contrast to the prior art devices, the present invention has a single movable flow control member upstream of the impeller 18, namely plug 30. Additionally, as best shown in FIG. 1, in the full open position, the plug 30 and the vanes 32 thereon have a minimal effect on the gaseous refrigerant flowing from inlet 14 to the impeller 18 because the vanes or airfoils are met head on by the flow under all conditions and flow along the vanes is for only a short distance in the FIG. 1 position. As the coaction of rack 36 and pinion 38 causes plug 30 to move from the FIG. 1 position toward the FIG. 2 position, the plug 30 and vanes 32 become more effective in controlling the flow but the turning or prewhirl only takes place after the vanes are met head on by the flow which continues in the same direction before being turned. Specifically, as the plug 30 moves from the full open position toward the minimal open position more and more flow is channeled between the vanes 32 as the point of greatest flow restriction advances downstream along the vanes 32. Since vanes 32 are highest and straightest relative to the axis of passage 16, plug 30 and impeller 18, at the upstream end, the initial closing movement of plug 30 essentially just reduces the cross-sectional area of the flow path and produces minimal change in flow direction. Further movement of the plug 30 toward closing further reduces the cross-sectional area of the flow path while increasingly placing a prewhirl on the gaseous refrigerant being supplied to the impeller 18. Finally, in the FIG. 2 position, the flow path is greatly restricted and the vanes 32 at the point of greatest restriction are at their maximum angle for inducing prewhirl.

Figure 3:
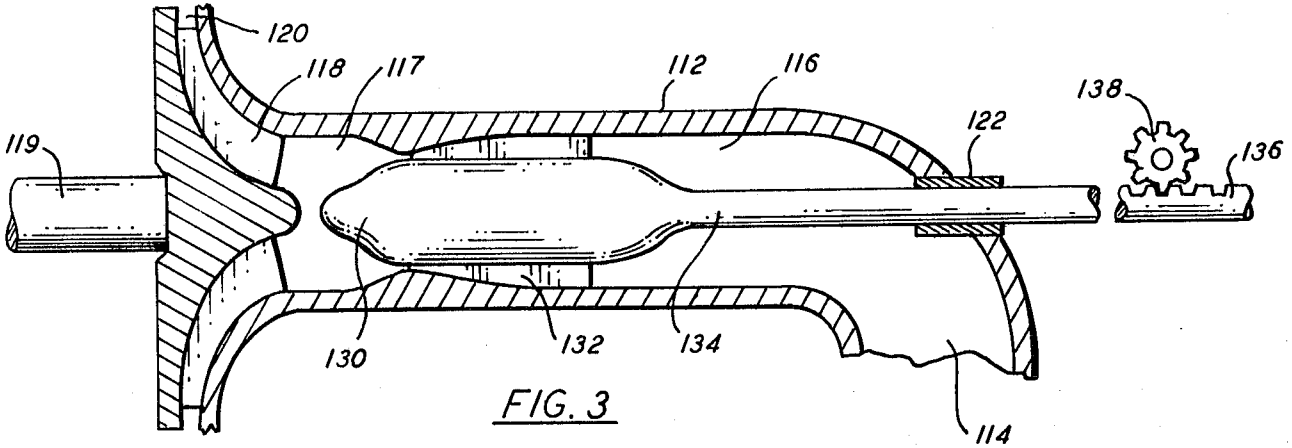
FIG. 3 is a partial sectional view of a gas compressor employing a modified capacity-prewhirl control mechanism in the minimum flow position.
Figure 4:
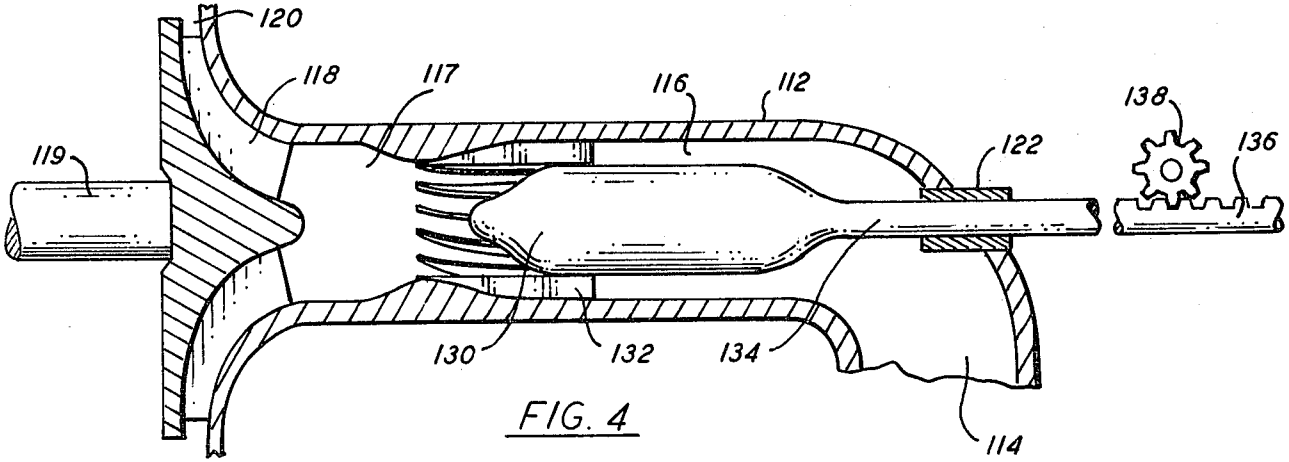
FIG. 4 shows the modified capacity-prewhirl control mechanism of FIG. 3 in the maximum flow position.

In FIGS. 3 and 4 a modified device is shown with corresponding parts being numbered 100 higher than in the FIG. 1 device. The FIG. 3 device differs from that of the FIG. 1 device in that the vanes 132 are located on the walls of passage 116 rather than on the plug 130. As a result, the passage 116 is of a reducing cross-sectional area corresponding to the reducing height of vanes 132 before transitioning into the compressor inlet chamber 117. The vanes 132, like vanes 32, are highest and straightest at their upstream end and transition in a downstream direction by a decreasing in height and becoming more helically extending. The vanes 132 provide sliding support for plug 130 which is also slidingly and sealingly supported by gland 122. The directions for movement of plug 130 for increasing and decreasing flow and prewhirl are opposite those for plug 30. The operation of the FIG. 3 device would otherwise be the same as that of the FIG. 1 device.

Figure 5:
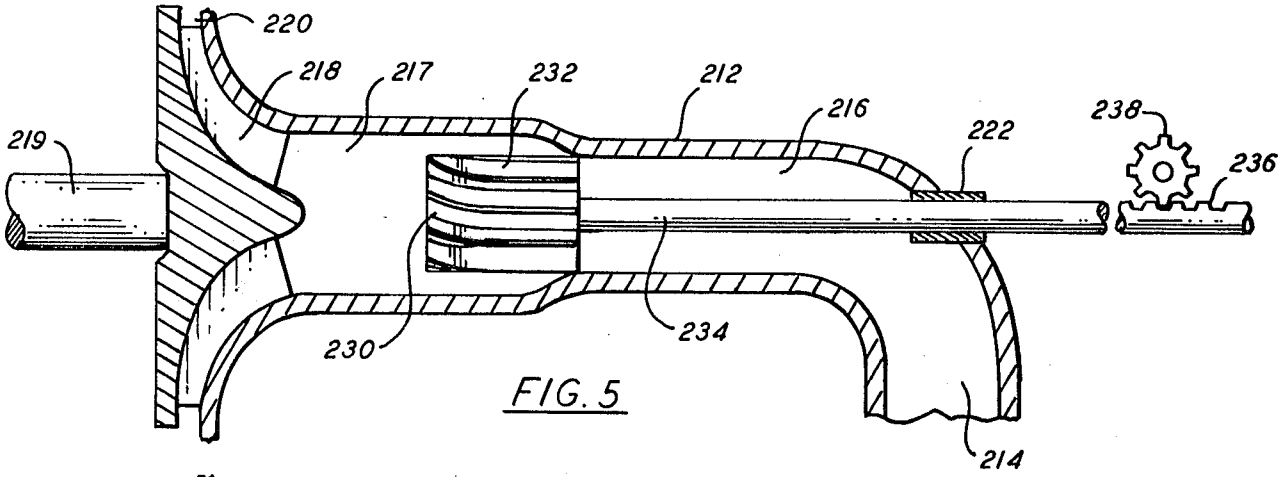
FIG. 5 is a partial sectional view of a prewhirl control mechanism in the minimum prewhirl position.
Figure 6:
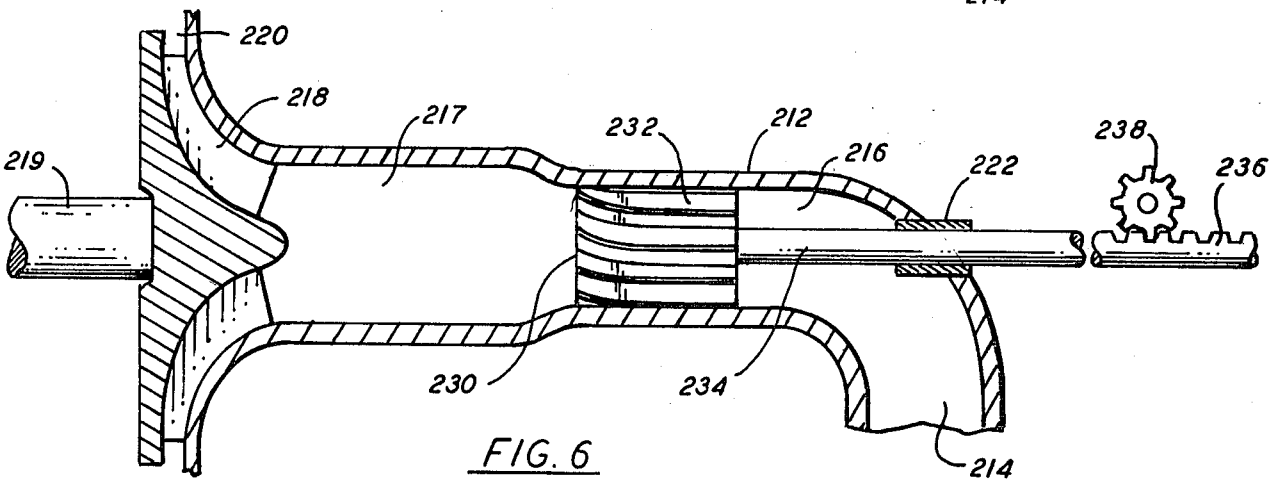
FIG. 6 shows the prewhirl control mechanism of FIG. 5 in the maximum prewhirl position.

FIGS. 5 and 6 illustrate a prewhirl control mechanism with corresponding parts being numbered 200 higher than in the FIG. 1 device. The prewhirl control mechanism 230 has vanes 232 which are of uniform height but which transition from an axial direction at the upstream end to a helically extending portion at the downstream end. Passage 216 which supportingly receives prewhirl control mechanism 230 is of a uniform cross-sectional area upstream of the prewhirl control mechanism 230 and transitions into compressor inlet chamber 217 which is of greater cross-sectional area. As best shown in FIG. 5, when the prewhirl control mechanism is in the minimum prewhirl position, the helically extending portion of the vanes 232 is located in the compressor inlet chamber 217 and while all of the flow passes between vanes 232, only a fraction of the flow passes through the helically extending portion of the vanes 232 and is given a prewhirl. However, as the control mechanism 230 moves from the FIG. 5 towards the FIG. 6 position the flow is required to pass through the vanes for longer distances and more of the flow is through the helically extending portion of the vanes 232. Ultimately, in the FIG. 6 position, all of the flow passes between the helically extending portion of the vanes and is given a prewhirl. In this device capacity control could be achieved by controlling compressor speed or movable diffuser structure, as is conventional.

Basically, in the present invention, a plug is reciprocatably located in a passage having a varying cross section with the plug and passage coacting to define an annular flow path. As the plug moves in a direction to reduce the minimum cross-sectional area of the flow path, the point of minimum cross-sectional area progresses from an area having axially directed vanes partially extending radially across the flow path to a smaller area having axially extending vanes across the entire flow path until a still smaller area having circumferentially directed vanes is reached so as to give an increasing prewhirl with decreasing compressor capacity. Alternatively, only prewhirl is achieved by moving a plug having axially extending vanes which transition into a helically extending direction in a downstream direction.

Although preferred embodiments of the present invention have been illustrated and described, other changes will occur to those skilled in the art. For example, the stroke of the plug, the number, length, height and angle of the vanes and the motive structure for reciprocating the plug can all be changed to meet design criteria while remaining within the scope of the present invention. Also, the present invention is applicable to axial as well as centrifugal compressors. It is therefore intended that the scope of the present invention is to be limited only by the scope of the appended claims.

What is claimed is:

1. In a compressor having a housing with an inlet and an outlet with a flow path therebetween and an impeller in said flow path, a capacity-prewhirl control mechanism comprising:

an area of reduced cross section in said flow path upstream of said impeller;

a plug means mounted in said flow path for reciprocating movement with respect to said area of reduced cross section and coacting therewith to define an annular flow path of variable cross-sectional area;

vane means in said annular flow path including a plurality of circumferentially spaced vanes each having an axially extending portion of a first height which transitions into a helically extending portion of reducing height in a downstream direction with all flow passing between said vanes at the point of minimum cross-sectional area in said annular flow path; and means for reciprocating said plug means whereby the area of said annular flow path is varied and the direction of the portion of said vanes located in said annular flow path at the point of minimum cross-sectional area is varied such that the angle of said vanes at the point of minimum cross-sectional area increases with decreasing minimum cross-sectional area.

2. The compressor of claim 1 wherein said vane means is located on said plug means.

3. The compressor of claim 1 wherein said vane means is formed in said housing and extends into said flow path.

4. A capacity-prewhirl control mechanism for controlling the capacity of a gas compressor and the angle of the fluid supplied to the impeller of the gas compressor comprising:

an axially extending passage having a first area which transitions into an area of increasing cross section in a down stream direction;

a plug means mounted in said passage for reciprocating movement with respect to the transition from said first area to said area of increasing cross section and coacting therewith to define an annular flow path of variable cross-sectional area;

a plurality of spaced vanes integral with said plug means and having an axially extending portion of a first height which transitions into a helically extending portion of reducing height in a downstream direction with all flow passing between said vanes at said transition from said first area to said area of increasing cross section; and means for reciprocating said plug means whereby the area of said annular flow path is varied and the direction of the portion of said vanes located in said annular flow path at the point of minimum cross-sectional area is varied such that the angle of said vanes at the point of minimum cross-sectional area increases with decreasing minimum cross-sectional area so as to increase the prewhirl as the capacity is decreased.

5. A capacity-prewhirl control mechanism for controlling the capacity of a gas compressor and the angle of the fluid supplied to the impeller of the gas compressor comprising:

an axially extending passage having a first area which transitions into an area of decreasing cross section in a down stream direction;

a plug means mounted in said passage for reciprocating movement with respect to the transition from said first area to said area of decreasing cross section and coacting therewith to define an annular flow path of variable cross-sectional area;

a plurality of spaced vanes integral with the wall of said flow path and having an axially extending portion of a first height which transitions into a helically extending portion of reducing height in a downstream direction to define said area of decreasing cross section with all flow passing between said vanes at the point of minimum cross-sectional area in said annular flow path; and means for reciprocating said plug means whereby the area of said annular flow path is varied and the direction of the portion of said vanes located in said annular flow path at the point of minimum cross-sectional area is varied such that the angle of said vanes at the point of minimum cross-sectional area increases with decreasing minimum cross-sectional area so as to increase the prewhirl as the capacity is decreased.

6. A prewhirl control mechanism for controlling the angle of the fluid supplied to the impeller of a gas compressor comprising:

an axially extending flow path having a first area which transitions into an area of increasing cross section in a down stream direction;

a plug means mounted in said flow path for reciprocating movement with respect to the transition from said first area to said area of increasing cross section and coacting therewith to define an annular flow path of constant cross-sectional area;

a plurality of spaced vanes integral with said plug means and having an axially extending portion which transitions into a helically extending portion in a down-stream direction with all flow passing between said vanes at said transition from said first area to said area of increasing cross section; and means for reciprocating said plug means whereby the direction of the portion of said vanes located at said transition from said first area to said area of increasing cross section and thereby the prewhirl is varied.

* * * * *